US010431013B2

(12) United States Patent
Leon et al.

(10) Patent No.: US 10,431,013 B2
(45) Date of Patent: Oct. 1, 2019

(54) HIGH SPEED PRINTING

(71) Applicant: Stamps.com Inc., El Segundo, CA (US)

(72) Inventors: J P Leon, Tucson, AZ (US); Keith Bussell, Los Angeles, CA (US)

(73) Assignee: Stamps.com Inc., El Segundo, CA (US)

( * ) Notice: Subject to any disclaimer, the term of this patent is extended or adjusted under 35 U.S.C. 154(b) by 347 days.

(21) Appl. No.: 14/075,405

(22) Filed: Nov. 8, 2013

(65) Prior Publication Data

US 2014/0067725 A1 Mar. 6, 2014

Related U.S. Application Data

(63) Continuation of application No. 13/591,817, filed on Aug. 22, 2012, which is a continuation of application No. 11/323,462, filed on Dec. 30, 2005, now Pat. No. 8,285,651.

(51) Int. Cl.
*G07B 17/02* (2006.01)
*G07B 17/00* (2006.01)

(52) U.S. Cl.
CPC . *G07B 17/00508* (2013.01); *G07B 17/00733* (2013.01); *G07B 2017/00064* (2013.01); *G07B 2017/0083* (2013.01); *G07B 2017/00491* (2013.01); *G07B 2017/00572* (2013.01)

(58) Field of Classification Search
CPC ..... G07B 17/0008; G07B 17/00362; G07B 17/00314; G07B 17/00733; G07B 2017/00064; G07B 2017/00491; G07B 2017/00572; G07B 2017/0083; G07B 17/00024; G07B 17/00508; G06Q 10/08345; G07F 17/26
USPC ..... 705/401, 335, 331
See application file for complete search history.

(56) References Cited

U.S. PATENT DOCUMENTS

| | | | |
|---|---|---|---|
| 2,148,155 | A | 2/1939 | Grossman |
| 4,201,339 | A | 5/1980 | Gunn |
| 4,742,878 | A | 5/1988 | Freeman et al. |
| 4,829,443 | A | 5/1989 | Pintsov et al. |
| 4,831,554 | A | 5/1989 | Storace et al. |
| 4,831,555 | A | 5/1989 | Sansone et al. |
| 4,864,618 | A | 9/1989 | Wright et al. |

(Continued)

FOREIGN PATENT DOCUMENTS

WO WO-2009055385 A1 4/2009

OTHER PUBLICATIONS

Cullen et al., Aug. 14-15, 1995, Reading Encrypted Postal Indicia, IEEE, pp. 1018-1023 (Year: 1995).*

(Continued)

*Primary Examiner* — Rupangini Singh
(74) *Attorney, Agent, or Firm* — Norton Rose Fulbright US LLP

(57) ABSTRACT

A system and method for high-speed processing of mail pieces is disclosed. The high-speed system includes client server that forms and prints a shipping label comprising reduced Information-Based Indicia (RIBI) on each piece of mail. The client server provides funds to the system server and reports the RIBI usage to the system server. The system server issues tokens to the client server that allow the client server to the print a shipping label including RIBI indicia for a certain value of postage.

12 Claims, 3 Drawing Sheets

(56) References Cited

U.S. PATENT DOCUMENTS 4,872,706 A 10/1989 Brewen et al.
5,064,221 A 11/1991 Miehe et al.
5,079,714 A 1/1992 Manduley et al.
5,094,554 A 3/1992 Hurd et al.
5,156,467 A 10/1992 Kitahara et al.
5,297,783 A 3/1994 Howard et al.
5,326,181 A 7/1994 Eisner et al.
5,360,628 A 11/1994 Butland
5,368,334 A 11/1994 Christy et al.
5,384,886 A 1/1995 Rourke
5,410,642 A 4/1995 Hakamatsuka et al.
5,423,573 A 6/1995 de Passille
5,425,586 A 6/1995 Berson
5,449,200 A 9/1995 Andric et al.
5,468,945 A 11/1995 Huggett et al.
5,471,925 A 12/1995 Heinrich et al.
5,494,445 A 2/1996 Sekiguchi et al.
5,502,304 A 3/1996 Berson et al.
5,510,992 A 4/1996 Kara
5,524,995 A 6/1996 Brookner et al.
5,554,842 A 9/1996 Connell et al.
5,569,317 A 10/1996 Sarada et al.
5,606,507 A 2/1997 Kara
5,612,888 A 3/1997 Chang et al.
5,612,889 A 3/1997 Pintsov et al.
5,617,519 A 4/1997 Herbert
5,651,238 A 7/1997 Belec et al.
5,666,215 A 9/1997 Fredlund et al.
5,682,318 A 10/1997 Kara
5,684,706 A 11/1997 Harman et al.
5,717,597 A 2/1998 Kara
5,717,980 A 2/1998 Oka et al.
5,737,729 A 4/1998 Denman
5,745,887 A 4/1998 Gargiulo et al.
5,794,981 A 8/1998 Flynn
5,801,944 A 9/1998 Kara
5,812,991 A * 9/1998 Kara ..... 705/410
5,819,240 A 10/1998 Kara
5,871,288 A 2/1999 Ryan, Jr. et al.
5,923,406 A 7/1999 Brasington et al.
5,932,139 A 8/1999 Oshima et al.
5,936,865 A 8/1999 Pintsov et al.
5,995,985 A 11/1999 Cai
6,005,945 A 12/1999 Whitehouse
6,033,751 A 3/2000 Kline
6,041,569 A 3/2000 Freeman et al.
6,079,327 A 6/2000 Sarada
6,173,274 B1 1/2001 Ryan, Jr.
6,175,826 B1 1/2001 Malandra, Jr. et al.
6,202,057 B1 3/2001 Pierce
6,208,980 B1 3/2001 Kara
6,226,626 B1 5/2001 Thiel
6,234,694 B1 5/2001 Brookner
6,249,777 B1 6/2001 Kara et al.
6,296,404 B1 10/2001 Pierce et al.
6,311,240 B1 10/2001 Boone et al.
6,322,192 B1 11/2001 Walker
6,370,844 B1 4/2002 Stricker
6,385,504 B1 5/2002 Pintsov et al.
6,397,328 B1 5/2002 Pitchenik et al.
6,415,983 B1 7/2002 Ulvr et al.
6,427,021 B1 7/2002 Fischer et al.
6,428,219 B1 8/2002 Stier et al.
6,438,530 B1 8/2002 Heiden et al.
6,461,063 B1 10/2002 Miller et al.
6,502,912 B1 1/2003 Bernard et al.
6,505,179 B1 1/2003 Kara
6,505,980 B1 1/2003 Allday
6,523,014 B1 2/2003 Pauschinger
6,526,391 B1 2/2003 Cordery et al.
6,594,374 B1 7/2003 Beckstrom et al.
6,595,412 B2 7/2003 Manduley
6,655,579 B1 12/2003 Delman et al.
6,671,407 B1 12/2003 Venkatesan et al.
6,671,813 B2 12/2003 Ananda
6,692,031 B2 2/2004 McGrew
6,697,822 B1 2/2004 Armatis et al.
6,701,304 B2 3/2004 Leon
6,722,563 B1 4/2004 Johnson et al.
6,735,575 B1 5/2004 Kara
6,820,201 B1 11/2004 Lincoln et al.
6,834,112 B1 12/2004 Brickell
6,834,273 B1 12/2004 Sansone et al.
6,868,406 B1 3/2005 Ogg et al.
6,889,214 B1 5/2005 Pagel et al.
6,902,265 B2 6/2005 Critelli et al.
6,904,168 B1 6/2005 Steinberg et al.
6,938,016 B1 8/2005 Ryan, Jr.
6,946,960 B2 9/2005 Sisson et al.
6,948,660 B2 9/2005 Critelli et al.
7,028,902 B2 4/2006 Xu et al.
7,039,214 B2 5/2006 Miller et al.
7,069,253 B2 6/2006 Leon
7,085,725 B1 8/2006 Leon
7,117,363 B2 10/2006 Lincoln et al.
7,127,434 B2 10/2006 Burningham
7,149,726 B1 12/2006 Lingle et al.
7,162,460 B2 1/2007 Cleckler et al.
7,191,158 B2 3/2007 Ogg
7,191,336 B2 3/2007 Zeller et al.
7,194,957 B1 3/2007 Leon et al.
7,201,305 B1 4/2007 Correa
7,222,236 B1 5/2007 Pagel
7,234,645 B2 6/2007 Silverbrook et al.
7,243,842 B1 7/2007 Leon et al.
RE39,779 E 8/2007 Kovlakas
7,266,531 B2 9/2007 Pintsov et al.
7,305,556 B2 12/2007 Slick et al.
7,363,105 B2 4/2008 Smith et al.
7,369,048 B2 5/2008 Freund
7,418,599 B2 8/2008 Peters
7,509,291 B2 3/2009 McBride et al.
7,577,618 B2 8/2009 Raju et al.
7,711,650 B1 5/2010 Kara
7,769,694 B2 8/2010 Schwartz et al.
7,828,223 B1 11/2010 Leon et al.
7,831,518 B2 11/2010 Montgomery et al.
7,874,593 B1 1/2011 Clem
7,933,845 B1 4/2011 Leon et al.
7,941,378 B2 5/2011 Carpenter et al.
7,954,709 B1 6/2011 Leon et al.
7,979,358 B1 7/2011 Clem et al.
8,065,239 B1 11/2011 McBride et al.
8,100,324 B1 1/2012 Leon
8,285,651 B1 10/2012 Leon et al.
8,360,313 B1 1/2013 Leon et al.
8,818,915 B1 8/2014 Leon et al.
9,208,620 B1 12/2015 Bortnak et al.
2001/0024228 A1 9/2001 Klinefelter et al.
2001/0042052 A1 11/2001 Leon
2001/0043350 A1 11/2001 Kasai et al.
2001/0054153 A1 12/2001 Wheeler et al.
2002/0023057 A1 2/2002 Goodwin et al.
2002/0033598 A1 3/2002 Beasley
2002/0040333 A1 4/2002 Fuwa
2002/0040353 A1 4/2002 Brown et al.
2002/0046195 A1 4/2002 Martin et al.
2002/0070149 A1 6/2002 Schererz et al.
2002/0073039 A1 6/2002 Ogg et al.
2002/0073052 A1 6/2002 Katikaneni et al.
2002/0083020 A1 6/2002 Leon
2002/0083021 A1 6/2002 Ryan et al.
2002/0127040 A1 9/2002 Davies et al.
2002/0149195 A1 10/2002 Beasley
2002/0149495 A1 10/2002 Schach et al.
2002/0190117 A1 12/2002 Manduley
2003/0002709 A1 1/2003 Wu
2003/0004900 A1 1/2003 Schwartz et al.
2003/0074324 A1 4/2003 Kresina et al.
2003/0101148 A1* 5/2003 Montgomery ... G07B 17/00508 705/404
2003/0140017 A1 7/2003 Patton et al.
2003/0144972 A1 7/2003 Cordery et al.
2003/0193530 A1 10/2003 Blackman et al.

(56) References Cited

U.S. PATENT DOCUMENTS

| | | | | |
|---|---|---|---|---|
| 2003/0217017 | A1 | 11/2003 | Willoughby et al. | |
| 2004/0000787 | A1 | 1/2004 | Vig et al. | |
| 2004/0001133 | A1 | 1/2004 | Critelli et al. | |
| 2004/0070194 | A1 | 4/2004 | Janetzke et al. | |
| 2004/0088267 | A1 | 5/2004 | Rasmussen et al. | |
| 2004/0125413 | A1 | 7/2004 | Cordery | |
| 2004/0174012 | A1 | 9/2004 | Hagen | |
| 2004/0186811 | A1 | 9/2004 | Gullo et al. | |
| 2004/0200902 | A1 | 10/2004 | Ishioroshi | |
| 2004/0211844 | A1 | 10/2004 | Marshall | |
| 2004/0215523 | A1 | 10/2004 | Wulff et al. | |
| 2004/0215583 | A1 | 10/2004 | Elliott | |
| 2004/0220935 | A1 | 11/2004 | McGraw et al. | |
| 2004/0236938 | A1 | 11/2004 | Callaghan | |
| 2004/0241424 | A1 | 12/2004 | Barbera-Guillem | |
| 2004/0254898 | A1 | 12/2004 | Parker et al. | |
| 2005/0065897 | A1 | 3/2005 | Ryan et al. | |
| 2005/0071296 | A1 | 3/2005 | Lepkofker | |
| 2005/0071297 | A1 | 3/2005 | Kara | |
| 2005/0076047 | A1 | 4/2005 | Starrett | |
| 2005/0080751 | A1 | 4/2005 | Burningham | |
| 2005/0082818 | A1 | 4/2005 | Mertens | |
| 2005/0087605 | A1 | 4/2005 | Auslander et al. | |
| 2005/0114276 | A1 | 5/2005 | Hunter et al. | |
| 2005/0195214 | A1 | 9/2005 | Reid et al. | |
| 2005/0256811 | A1 | 11/2005 | Pagel et al. | |
| 2006/0036557 | A1* | 2/2006 | Mattern | 705/408 |
| 2006/0064311 | A1* | 3/2006 | Baker | G06Q 30/04 705/401 |
| 2006/0116971 | A1 | 6/2006 | Beckstrom et al. | |
| 2006/0136347 | A1 | 6/2006 | Reichelsheimer et al. | |
| 2006/0173796 | A1 | 8/2006 | Kara | |
| 2006/0248348 | A1 | 11/2006 | Wakao et al. | |
| 2006/0287096 | A1 | 12/2006 | O'Kelley, II et al. | |
| 2007/0005518 | A1 | 1/2007 | Beckstrom et al. | |
| 2007/0011995 | A1 | 1/2007 | Weaver et al. | |
| 2007/0017985 | A1 | 1/2007 | Lapstun et al. | |
| 2007/0073587 | A1 | 3/2007 | Walker et al. | |
| 2007/0100672 | A1 | 5/2007 | McBrida et al. | |
| 2007/0129957 | A1* | 6/2007 | Elliott | G07B 17/00435 705/408 |
| 2007/0179853 | A1 | 8/2007 | Feige et al. | |
| 2007/0198441 | A1 | 8/2007 | Kara | |
| 2007/0255664 | A1 | 11/2007 | Blumberg et al. | |
| 2009/0125561 | A1 | 5/2009 | Garcia | |
| 2010/0312627 | A1 | 12/2010 | Khechef et al. | |
| 2013/0066794 | A1 | 3/2013 | Hill et al. | |

OTHER PUBLICATIONS

Pintsov, Leon et al., "Postal Revenue Collection in the Digital Age", Springer Berlin/Heidelberg, Financial Cryptogrpahy, Jan. 1, 2001, 19 pgs.

Postnet Barcode Certification User Guide, United States Postal Service, Aug. 1997, 8 pages.

Postage Payment Methods: Stamps, 604, Domestic Mail Manual, Jan. 8, 2006, 46 pages.

U.S. Appl. No. 11/114,964 to Clem et al., filed Apr. 25, 2005, and entitled "Quality Assurance of Image-Customization of Computer-Based Value-Bearing Items," 122 pages.

U.S. Appl. No. 11/644,458 to Leon, filed Dec. 20, 2006, and entitled "Systems and Methods for Creating and Providing Shape-Customized, Computer-Based, Value-Bearing Items," 77 pages.

U.S. Appl. No. 12/316,240 to Leon, filed Dec. 9, 2008, and entitled "Systems and Methods for Facilitating Replacement of Computer-Based Value-Bearing Items," 158 pages.

U.S. Appl. No. 12/943,519 to Clem, filed Nov. 10, 2010, and entitled "Rolls of Image-Customized Value-Bearing Items and Systems and Methods for Providing Rolls of Image-Customized Value-Bearing Items," 65 pages.

U.S. Appl. No. 12/500,970 to Clem, filed Jul. 10, 2009, and entitled "Automatic Guarantee Delivery Tracking and Reporting for United States Postal Service Postage Refunds for Paid Computer-Based Postage," 70 pages.

U.S. Appl. No. 11/729,148 to Leon et al., filed Mar. 27, 2007, and entitled "Computer-Based Value-Bearing Item Customization Security," 131 pages.

U.S. Appl. No. 11/729,239 to Leon et al., filed Mar. 28, 2007, and entitled "Computer-Based Value-Bearing Item Customization Security," 131 pages.

U.S. Appl. No. 10/994,914 to McBride et al., filed Nov. 22, 2004, and entitled "Customized Computer-Based Value-Bearing Item Quality Assurance," 131 pages.

U.S. Appl. No. 10/994,728 to Huebner et al., filed Nov. 22, 2004, and entitled "Printing of Computer-Based Value-Bearing Items," 122 pages.

U.S. Appl. No. 10/994,768 to Leon et al., filed Nov. 22, 2004, and entitled "Computer-Based Value-Bearing Item Customization Security," 129 pages.

U.S. Appl. No. 11/509,309 to Leon, filed Aug. 24, 2006, and entitled "Invisible Fluorescent Ink Mark," 15 pages.

U.S. Appl. No. 11/435,453 to Clem., filed May 16, 2006, and entitled "Rolls of Image-Customized Value-Bearing Items and Systems and Methods for Providing Rolls of Image-Customized Value-Bearing Items," 69 pages.

U.S. Appl. No. 10/994,698 to Leon et al., filed Nov. 22, 2004, and entitled "Image Customization of Computer-Based Value-Bearing Items," 126 pages.

Tabor, Teresa "Postal Package Partner Subscribers(Tm) USPS Rate Price Statements Change Jan. 18 2009," Dec. 22, 2008, windowbook.com, 3 pages.

Taylor, Mark "USPS Announces 2010 Price Reduction," Nov. 7, 2009, shippingcoach.wordpress.com, 3 pages.

Unpublished U.S. Appl. No. 12/103,496 to Bortnak et al., filed Apr. 15, 2008 and entitled "Systems and Methods for Activation of Postage Indicia at Point of Sale," 40 pages.

* cited by examiner

HIGH SPEED PRINTING

CROSS-REFERENCE TO RELATED APPLICATIONS

The present application is a continuation of co-pending, commonly assigned, patent application Ser. No. 13/591,817 entitled "HIGH SPEED PRINTING," filed Aug. 22, 2012, which itself is a continuation of commonly assigned, patent application Ser. No. 11/323,462 entitled "HIGH SPEED PRINTING," filed Dec. 30, 2005, now U.S. Pat. No. 8,285,651 issued Oct. 9, 2012 and this application is related to commonly assigned U.S. patent application Ser. No. 10/677,619 entitled "SYSTEM AND METHOD FOR HIGH-SPEED POSTAGE APPLICATION MANAGEMENT," filed Oct. 2, 2003, now U.S. Pat. No. 8,250,000 issued Aug. 21, 2012; and co-pending U.S. patent application Ser. No. 11/323,463 entitled "SYSTEMS AND METHODS FOR SINGLE PASS PRINTING POSTAGE INDICIA," filed Dec. 30, 2005; U.S. patent application Ser. No. 10/994,768 entitled "COMPUTER-BASED VALUE-BEARING ITEM CUSTOMIZATION SECURITY," filed Nov. 22, 2004, now U.S. Pat. No. 7,243,842 issued Jul. 17, 2007; U.S. patent application Ser. No. 10/994,914 entitled "CUSTOMIZED COMPUTER-BASED VALUE-BEARING ITEM QUALITY ASSURANCE," filed Nov. 22, 2004, now U.S. Pat. No. 8,065,239 issued Nov. 22, 2011; co-pending U.S. patent application Ser. No. 10/994,728 entitled, "PRINTING OF COMPUTER-BASED VALUE-BEARING ITEMS," filed Nov. 22, 2004; U.S. patent application Ser. No. 10/994,698 entitled "IMAGE-CUSTOMIZATION OF COMPUTER-BASED VALUE-BEARING ITEMS," filed Nov. 22, 2004, now U.S. Pat. No. 7,933,845 issued Apr. 26, 2011; and U.S. patent application Ser. No. 11/114,964 entitled "QUALITY ASSURANCE OF IMAGE CUSTOMIZATION OF COMPUTER-BASED VALUE-BEARING ITEMS," filed Apr. 25, 2005, now U.S. Pat. No. 7,979,358 issued Jul. 12, 2011, the disclosures of which are hereby incorporated herein by reference.

TECHNICAL FIELD

The present invention is generally related to high-speed mail processing systems and, more particularly, to a high-speed mail handling system that applies postage or Information-Based Indicia (IBI) to each mail piece on a piece-by-piece basis.

BACKGROUND OF THE INVENTION

Approximately eighty percent of the current stream of letter mail is produced in the high-speed postage environment. Postage is produced at about 70,000 pieces per hour by high-speed postage machines. Typically, items such as utility bills, direct mail pieces and catalogs are processed in this manner. These items are produced on machines that are generically called inserters. Mail pieces move along a conveyor belt through the various components of the machine. Postage is applied on the mail pieces in various ways, such as permit mail or metered mail.

In the case of metered mail, at the end of the high-speed conveyor belt, there is a traditional electro-mechanical meter that applies postage to the items. A plate representing the postage value is pressed down on each mail piece to mark the postage. The postage is printed with a phosphorescent ink. The development of meter machines has not kept up with improvements in the rest of the high speed postage equipment. As a result, the meters are actually slower than the rest of the machine. In other words, the other elements the high-speed process, such as inserters, folders and stuffers, move mail faster than the traditional meter can print the required postage.

One example of a high-speed system is a manifest system. The manifest system is an enhancement to the United States Postal Service's (USPS) permit system, which allows non-unique conditions to be applied to each envelope that indicated the postage that should be paid for the envelope. The permit system simply identifies the permit holder's number and where it is being mailed from and the class of mail to be used. In the permit system, all pieces needed to be of identical weight and of an identical mail class. The pieces where then weighed to determine the total postage due. The manifesting system allows pieces of various weights and mail classes to be mixed into a single batch by applying a unique number to each mail piece. That unique number is keyed to a character code that describes the rate category, the weight of the mail piece and the postage amount for that individual piece.

The mail pieces are presented along with a document that describes each piece within the mailing, including each piece's unique number and weight, and the postage amount for each piece. This information can then be checked in a statistical fashion in order to insure that those mail pieces are actually in the permit system. This system requires inspection upon presentment of the mailing to the USPS in order to assure compliance, and requires more steps and more bookkeeping than system that use live postage.

As is well-known, postage is based on the weight of the mail items. Some types of mail, such as bills, will include a different number of pages in each piece. For example, customers who have charged a lot of purchases may have more pages in their credit card bills than customers who have made a single purchase. Additionally, some advertising inserts may be included in some customers bills, but not others. Therefore, each mail piece will have a different weight. This causes a problem with traditional meters because, in the high-speed postage environment, the meters typically need to be set up for a single postage value because the postage value cannot be changed quickly. Every piece that goes through the line needs to have the same postage value applied in the traditional high-speed mailing environment.

Other arrangements have been attempted to solve these problems, such as physically splitting the processing line to send mail pieces to multiple postage meters, wherein each meter is set at a different postage value. While this arrangement allows different postage values to be applied to different mail pieces of varying weight, this is an expensive solution that requires additional equipment, such as multiple postage meters and a mechanism to sort pieces by weight. Additionally, in this solution, the postage value options are limited by the number of meters that are installed.

Another problem with these types of systems is security. In the current environment of the USPS, there is an initiative to remove all of these traditional type printers or meters that are being used because the USPS view them as security issues. These systems have very little protection of the funds that are inside the meter itself. There are easy ways to manipulate the registers that keep the funds inside those meters. Moreover, there is a great difficulty in accounting for each piece of mail, such that the USPS cannot be sure that each piece of mail has had is postage properly paid for. Thus, running through millions of pieces of mail through these traditional meters, the USPS is viewing the usage of the meters as a huge loss of postage revenue due to the USPS.

Pitney Bowes has a version of a high speed postage meter that is fast enough to work in a high volume environment. These meters produces an indicia that is known as a digital indicia, or bar code, which encodes variable information into each postage indicia. The variable information may comprise information as to where indicia came from, how much postage has been paid for, the serial number of that meter and so forth. Thus, this provides more security, because the additional information allows the USPS (or other entity) to be able to trace mailing back to ensure that the postage has been properly paid for that piece of mail. One drawback with these systems is that they are expensive. Using one of these systems increases the cost of mailing each envelope from fractions of a cent to one or more cents.

BRIEF SUMMARY OF THE INVENTION

The present invention is directed to a system and method that uses a reduced Information-Based Indicium (RIBI) that is printed by a high-speed printer that operates faster than traditional postage meters. Note that as used herein indicium is singular and indicia is plural.

Embodiments of the invention comprises a client server and a system server. The client server that forms and prints a RIBI indicium on each piece of mail. The client server provides funds to the system server and reports the RIBI usage to the system server. The reported information includes information that would allow the formation of a full IBI indicium. The system server issues tokens to the client server based on the received funds. The tokens allow the client server to the print RIBI indicia for a certain value of postage. Printing a RIBI is faster than printing an IBI. The IBI can only be printed with a system that includes a trusted e-meter, while the RIBI may be printed on a system that does not include a trusted e-meter.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 5:
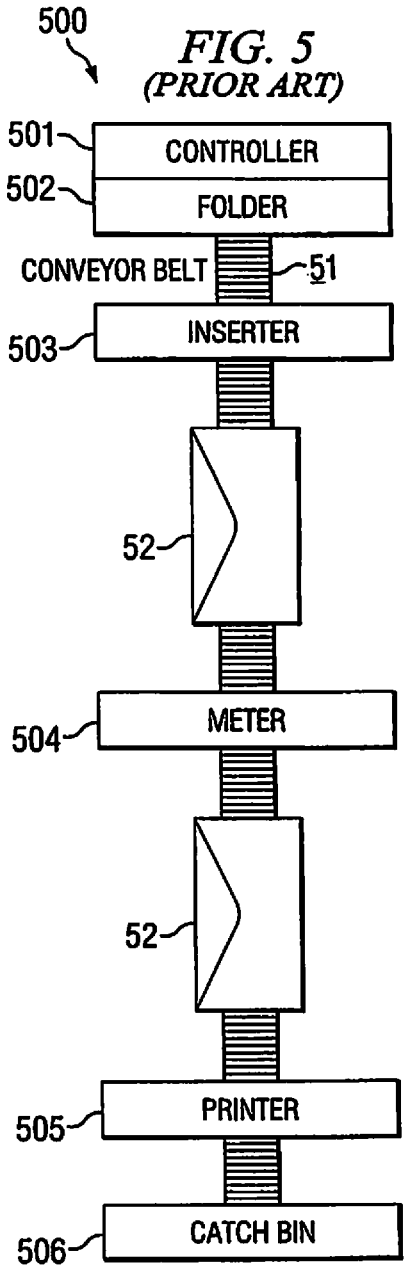
FIG. 5 (PRIOR ART)
FIG. 5 is a block diagram of a prior art high-speed mail processing system.

FIG. 5 illustrates an existing system 500 for processing mail pieces. Controller 501 communicates with folder 502, inserter 503, meter 504, and printer 505 and controls the entire process. The component parts of each mail piece travel through folder 502 where they are assembled and folded. The folded pieces then travel along conveyor belt 51 to inserter 503 where the folded pieces are inserted into an envelope. Stuffed envelope 52 is then moved by conveyor belt 51 past meter 504, which applies postage of a predesignated value to envelope 52. Marked envelope 52 then travels along conveyor 51 to printer 505 where the addressing information is printed. Envelope 52 continues down conveyor 51 to catch bin 506 where it is stored in sorted order.

It will be understood by those of skill in the art that any of devices 502, 503, or 505 can be eliminated from system 500, if necessary. Meter 504 is a mechanical imprint stamp and, therefore, must print all the postage the same way. Accordingly, in the existing systems, every letter 52 must have the same weight and must be of the same class. If the weight or class vary, the machine must be stopped and meter 504 has to be reset for a new class or weight. In situations where multiple postages are required, conveyor belt 51 could be split (not shown) into two or more paths after inserter 503 and prior to meter 504. Each of the paths would have a separate meter 504, each meter having postage for a unique class and weight. In this matter multiple postage amounts may be applied using the existing high-speed production line. However, this requires additional equipment and, therefore, additional expense. Also, the number of available postage options is limited by the number of meters 504 that are added to the line.

Figure 1:
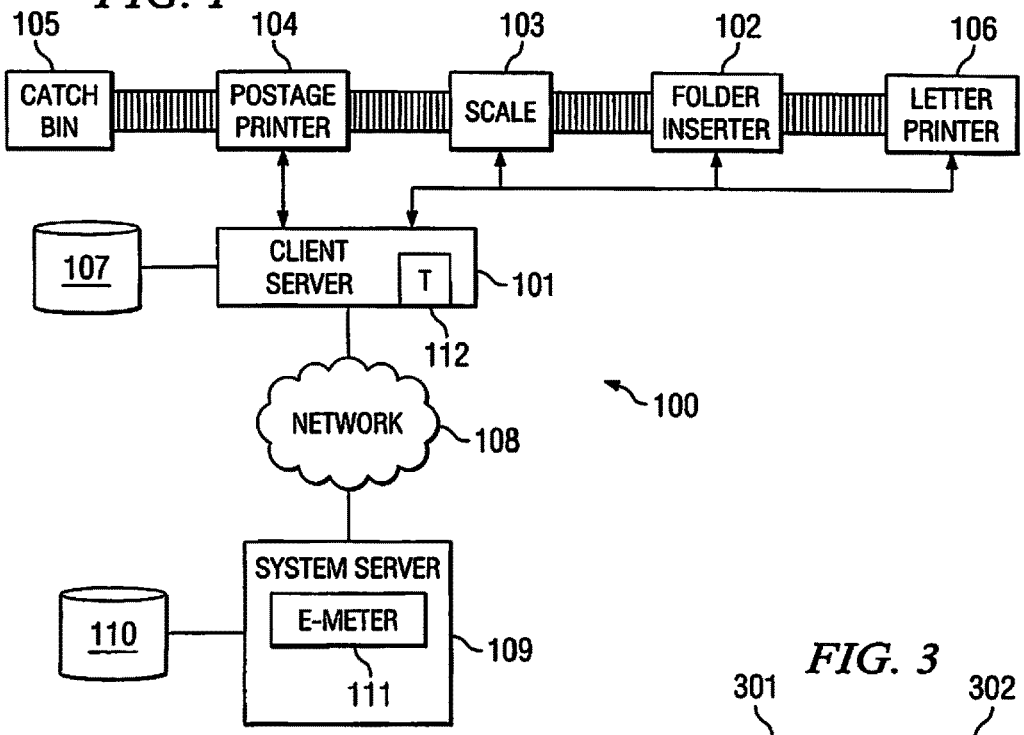
FIG. 1 is a block diagram of a high-speed mail processing system incorporating embodiments of the present invention.

FIG. 1 illustrates high-speed mailing system 100 embodying aspects of the present invention. System 100 includes some of the same components as used in the prior art system illustrated in FIG. 5. Client server 101 communicates with system server 109 via a network 108, e.g. an intranet or Internet. The postage value and/or the applied postage indicium may be different for each mail piece. In system 100, there is no requirement that all of the mail pieces flowing through the system have the same postage value and/or be of the same class. Therefore, it is possible to intersperse different types of mail pieces and even to simultaneously process mail pieces from different companies. Each of the mail pieces is tracked by at least one of server 101 and server 109 so that system 100 tracks the proper postage for each mail piece as it is processed through the system. Note that the embodiments are described in terms of envelopes or mail pieces, however, envelopes or mail pieces may include postcards, boxes, packages, tubes, or any other item that may be sent through the mail. Further note that system server 109 may be connected to one or more client servers 101.

Letter processing involves an optional letter printer 106 which prints the enclosures to be mailed. One or more pre-printed letters may be supplied to the system in lieu of the printer 106, e.g. a stack of letters. A folder/inserter 102 optionally folds the enclosures that are to be mailed and then inserts them into an envelope. The letters may be proportionally sized to the envelope such that folding is not necessary. An optional scale 103 may be used to weigh each envelope for postage calculation purposes. Note that postage may be calculated by estimating the weight of the envelope, especially when the number and weight of the enclosures and the weight of the envelope is known. Printer 104 prints a postage indicium onto the envelope. Catch bin 105 receives the envelope with the printed postage. Note that postage indicium may be applied in any orientation and at any location on the envelope. Alternatively, printer 104 may print the postage indicium onto a label which is then attached to envelope. Printer 104, another printer (not shown), or a label maker (not shown) may print either or both of a source address and a destination address to the envelope or may attach a label with the either or both of the address(es) to the envelope, as well as other envelope features such as a printed border, e.g. the standard red and blue airmail border or other design, tracking information, and/or orientation information (e.g. a facing indication mark). Database 107 contains information regarding the mail pieces to be processed by system 100. This information includes items such as the source address, destination address, mail class, folding method, weights of the inserted pages, and the other information to be used for each production job. The system may operate continuously to process mail.

The printed postage amount may be computed by client server 101, system server 109, or other postage computing device (not shown), which uses information about the individual mail piece. System 100 is able to determine the postage due on a piece-by-piece basis. Printer 104 can print postage indicia for any postal class and for any weight. Accordingly, in system 100, the mail pieces can vary by class and weight and a single production line can be used to process these mail pieces.

In an embodiment, server 101 is a single device that controls the operation of the client server side of the system 100, however, other embodiments may have the different functions separated into one or more other components. For example, the postage computing may be performed by a separate processor. Server 101 may direct the letter printer to generate one or more letters to be mailed. Server 101 may then direct folder-inserter 102 to combine and/or fold the one or more pages of the letter, and then insert them into an envelope. Using an actual weight of the stuffed envelope from optional scale 103 or an estimated weight of the stuffed envelope from information stored in database 107, the server may calculate the amount of postage that is required to mail the envelope. The calculations may be based upon different criteria, such as the weight of envelope, the class of the envelope, and a destination of the envelope.

The e-meter 111 is the trusted structure that generates the data for a full IBI indicium. Note that there may be more than one e-meter. One or more e-meters may be dedicated to each client server. Alternatively, the one or more e-meters may be shared by the different client servers, wherein each client server has an associated data record that is loaded into the e-meter(s) when the client server interacts with the system server. For further information see U.S. Pat. No. 6,889,214, Pagel et al., issued May 3, 2005, and U.S. patent application Ser. No. 10/862,058, entitled "VIRTUAL SECURITY DEVICE," filed Jun. 4, 2004. As shown in FIG. 1, the e-meter may reside in the system server 109. However, the e-meter may also reside in the client server 101. The e-meter may be a software, hardware, or combination structure.

In an embodiment, postage application printer 104 is a high-speed ink jet printer that prints an Information-Based Indicia (IBI) on the envelopes or mail pieces. The IBI is a fully (or at least partially) computer-readable mark, e.g. a bar code, which comprises encrypted information which provides security to the postage system but reducing the risks of forgery, meter tampering, and unauthorized use. Each IBI is unique and may include information such as one or more of a date, a time, a printer registration number, a user number, a source address, a destination address, mailing information (e.g. postage value, class, weight, size of the envelope, and/or number of pages, etc.), an IBI serial number, a digital signature, zip code, tracking information, and special services information (e.g. insurance, return receipt, certified mail, registered, express mail, or other services).

Thus, each envelope would be marked with a unique IBI. The data for the IBI may be formed by either server 101, server 109, or by a combination of both servers. Note that if the data is formed by server 109 or a combination of servers 101 and 109, then the data for the IBI is provided to server 101. The IBI may include human readable information such as a postage amount, a USPS postal mark, and/or a client selected indicia. Note that the IBI data may be collected or inputted into the system server 109 and stored on the database 110.

The information encoded into information based postage indicia has typically included sufficient information to authenticate an indicium from information on the face on the postal item. For example, the machine readable portion of an information based postage indicium may include an indicia version number, an algorithm identification, a software identification, a label sheet identification, a label identification, a vendor identification, a meter number, a postal security device model number, a postal security device serial number, a transaction number, an ascending register value, a descending register value, the postage value, addressor information, addressee information, originating zip code, a date of creation of the postage indicia, a mail category, a digital signature, an authentication certificate number, and/or an authentication certificate, perhaps signed using public key/private key cryptography. Accordingly, information based postage indicia may often comprise 64-96 bytes of encoded information. A current configuration of information based indicia acceptable to the United States Postal Service comprises the following information encoded in the machine readable portion thereof.

| Field Order in Indicia | IBI DD Field Reference Number | Field Length | Indicia Offset | Data Elements |
|---|---|---|---|---|
| 1 | 11 | 1 | 0 | Indicia Version Number |
| 2 | 1 | 1 | 1 | Algorithm ID |
| 3 | 3 | 4 | 2 | Certificate Serial Number |
| 4 | 10 | 2 | 6 | IBI Vendor ID |
| 5 | 16 | 2 | 8 | PSD Model Number |
| 6 | 17 | 4 | 10 | PSD Serial Number |
| 7 | 2 | 5 | 14 | Ascending Register |
| 8 | 15 | 3 | 19 | Postage Value |
| 9 | 5 | 4 | 22 | Date of Creation |
| 10 | 14 | 4 | 26 | Originating Zip Code |
| 11 | 18 | 2 | 30 | Software ID2 |

-continued

| Field Order in Indicia | IBI DD Field Reference Number | Field Length | Indicia Offset | Data Elements |
|---|---|---|---|---|
| 12 | 27 | 7 | 32 | LabelSheetID |
| 13 | 28 | 2 | 39 | LabelID |
| 14 | 7 | 4 | 41 | Descending Register |
| 15 | 12 | 4 | 45 | Mail category |
| 16 | 9 | 40 | 49 | Digital Signature |

Use of a two-dimensional barcode, such as PDF 417, DataMatrix, or MaxiCode, to encode such information in an information based postage indicia results in a relatively large postage indicium.

An IBI that includes all or much of the information outlined above may require a large-sized indicia, that in turn, may require a significant amount of time to print onto the envelope, such that the system 100 may operate at a slow or less-than optimum speed. Thus, an IBI Light indicia may be used. Going forward, this type of indicia will be referred to as a Reduced IBI or RIBI in this application. RIBI may have a size of 32 bytes or less of data, while IBI typically has 64 bytes or more of data. The reduced size allows a standard ink-jet printer to print the indicia in a single pass, thus increasing the speed of the system, while reducing the cost of the system by allowing standard printers to be used (or at least standard printer components to be used). The data for the RIBI may be formed by either server 101, server 109, or by a combination of both servers. Note that if the data is formed by server 109 or a combination of servers 101 and 109, then the data for the RIBI is provided to server 101. Note that if the RIBI formation involves the server 101, then the server 101 and/or the software associated with RIBI formation will have security features to prevent tampering with RIBI formation.

To maintain postal security, the RIBI should include enough data to allow for association of the RIBI with the full data typically needed to form a IBI indicium. In a first embodiment, the RIBI indicium may comprise a portion of the IBI indicium. The IBI indicium is formed using the standard information, then the RIBI indicium is formed from a portion of the IBI indicium. For example, the first 21 bytes of the IBI indicium is used as the RIBI indicium, and the remaining bytes of the IBI are not used in the RIBI. In a second embodiment, the RIBI indicium is formed using a portion of the data used in forming the IBI indicium. For example, suppose the IBI indicium is to be formed by from the following information: a date, a time, a printer registration number, a user number, a source address, and a destination address. The RIBI indicium may be formed by using only a date, a time, and a printer registration number. In a third embodiment, the RIBI indicium may comprise a pointer that points to a database address for the IBI information.

In any event, database 107 would include entries for the RIBI and the corresponding IBI information and/or data for each of the RIBIs that have been applied to envelopes. This information may be shared with database 110 of the system server 109. The USPS may be supplied or access information from server 109 (including database 110) and/or server 101 (including database 107). Note that the second and third embodiments do not require the formation of IBI indicia. For these embodiments, the IBI information that is used to form the indicia may be stored without storing the IBI indicia. Thus, for these two embodiments, the client server need not form IBI indicium, nor does the client server need to have the ability to form the IBI indicium.

Light information based postage indicium is referred to as "light" or "reduced" herein due to the information based postage indicia encoding a reduced set of data in the indicia. The RIBI data may be collected or inputted into client server 101 and stored on database 107. Although light information based postage indicium of embodiments of the invention provides for encoding postage data therein, such as indicia version number, meter number, vendor identification, vendor model number, postal security device model number, transaction number, piece counter, ascending register value, descending register value, postage value, addressor information, addressee information, posting zip code, mail service information, authentication certificate number, and/or authentication certificate, light information based postage indicium encodes less postage data than is encoded in information based postage indicium. For example, embodiments of light information based postage indicium encode approximately 20 bytes of information within machine readable portion rather than the 64-96 bytes of information encoded within the machine readable portions of information based postage indicia. A configuration of light information based indicia acceptable to the United States Postal Service comprises the following information encoded in the machine readable portion thereof.

| | IBI DD Field Reference Number | Field Length | Indicia Offset | Data Elements |
|---|---|---|---|---|
| 1 | 11 | 1 | 0 | Indicia Version Number |
| 2 | 30 | 4 | 1 | Piece Counter |
| 3 | 35 | 1 | 5 | IBI Vendor/Model |
| 4 | 36 | 3 | 6 | PSD Serial Number 3 |
| 5 | 15 | 3 | 9 | Postage Value |
| 6 | 37 | 2 | 12 | Intelligent Mail Service |
| 7 | | 6 | 14 | Blank |

Figure 3:
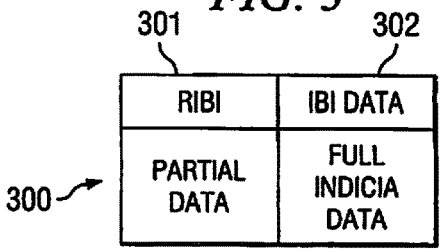
FIG. 3 is an example of a database entry for a Reduced IBI and the associated data of an IBI.

FIG. 3 depicts an example of a data entry 300 in a database, e.g. database 107 and/or database 110. The data entry includes RIBI data 301 and the associated IBI data 302.

Figure 2:
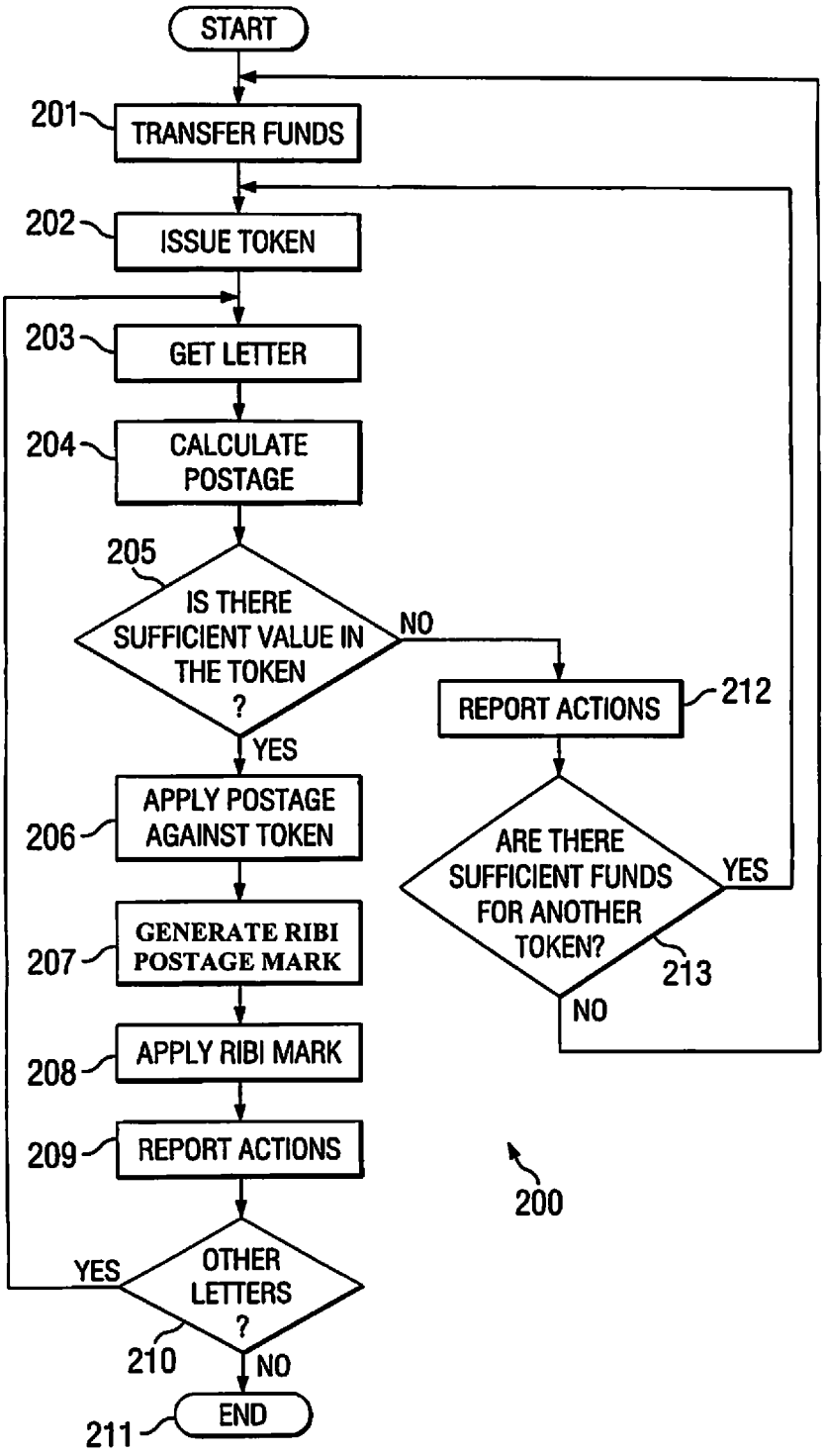
FIG. 2 is a flow chart illustrating a process incorporating embodiments of the present invention.

FIG. 2 shows an example of process 200 that marks envelopes with an RIBI indicium using the system 100 of FIG. 1, Note that system 100 may use other processes and process 200 may be used on other systems. The process 200 starts by transferring funds 201 from the client server 101 to the system server 109. Once the funds have been received, system server 109 issues a token to client server 101. The token represents a value of postage that the client is allowed to mark envelopes with. The token may be equal to the amount of funds received or may be a lesser amount. Fur example, $1000 US funds may have been transferred, while the issued token may be for $100 US postage. The e-meter 111 in the system server 109 may maintain a balance of available fund. Token register 112 in the client server 101 may maintain a balance of available postage.

After the token has been received, the client server 101 may begin processing mail by stuffing a letter into an envelope 203. The client server may then calculate the postage for the letter 204 as described above. The client server then checks to see if sufficient value in the token for this letter 205. If not, then the process proceeds to block 212. If so, then client server applies the calculated postage against the token 206. The client server may then generate the RIBI indicium 207 using one of the three embodiments described above. The generated RIBI and the associated IBI information is logged in database 107. Alternatively, the system server may generate the RIBI indicium and then provide the indicium to the client server; or the system server and the client server may form the RIBI indicium together. The printer 104 would then apply the RIBI indicium to the envelope 208. Note that server(s) may generate the indicium and send it to the printer, such that the printer receives printing instructions. Alternatively, the printer may be an intelligent printers such that the printer generates and prints the indicium.

In block 209, the process may optionally report the action of the client server to the system server. The report may include recent data base entries of RIBI data and the associated IBI information. The reported information would allow the system server to form additional IBI information and/or an IBI indicium, if necessary, such that each RIBI indicium may be authenticated with an IBI indicium. The process then checks to see if there are more letters 210. If not, then the process ends at 211. If so, then the process returns to block 203 to get the next letter and repeats. Note that IBI information and/or IBI indicium formation by the system server may occur after or in parallel with RIBI formation by the client server.

If there is not sufficient value in the token at block 205, the process then proceeds to block 212, where the actions of the client server are reported to the system server. The report may include recent data base entries of RIBI data and the associated IBI information. The reported information would allow the system server to form additional IBI information and/or an IBI indicium, if necessary, such that each RIBI indicium may be authenticated with an IBI indicium. Note that IBI information and/or IBI indicium formation by the system server may occur after or in parallel with RIBI formation by the client server. Either the reporting of the actions or a separate message would be sent to the system server to indicate that the client server needs another token. The system server would then determine whether sufficient funds exist to issue another token. If so, then the system server returns to block 202 and issues another token. If not, then the system server would send a message or otherwise indicate need for additional funds to the client server. The client server would then send the funds to the system server, and the process would return to block 201.

The reporting action blocks 209 and 212 are optional. The process may have only one of blocks 209 and 212, both of blocks 209 and 212. Block 209 incrementally reports the use of each indicium to the system server. Block 212 reports the indicia usage on a per token basis. Thus, each indicia that was generated and used against a token is reported when the value of the token value is insufficient for further postage. The reporting block(s) may be used at other locations in the process. Reporting may be a requirement for further tokens to be issued. In other words, no further tokens will be issued to the client server until the client server reports the information on the indicia formed for the previous token. Typical reporting actions may include the transfer of the RIBI/IBI entries 300 in the database 107 to the system server.

The system server may send the reporting information to the USPS. Alternatively, the USPS may download the reporting information from one or both of the databases 107 and 110. Thus, the system server or the USPS may review the RIBI information printed onto a envelope and then using the database entries determine the IBI information for the particular piece of mail.

Note that any of the functions described herein may be implemented in hardware, software, and/or firmware, and/or any combination thereof. When implemented in software, the elements of the present invention are essentially the code segments to perform the necessary tasks. The program or code segments can be stored in a processor readable medium or transmitted by a computer data signal embodied in a carrier wave, or a signal modulated by a carrier, over a transmission medium. The "processor readable medium" may include any medium that can store or transfer information. Examples of the processor readable medium include an electronic circuit, a semiconductor memory device, a ROM, a flash memory, an erasable ROM (EROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

Figure 4:
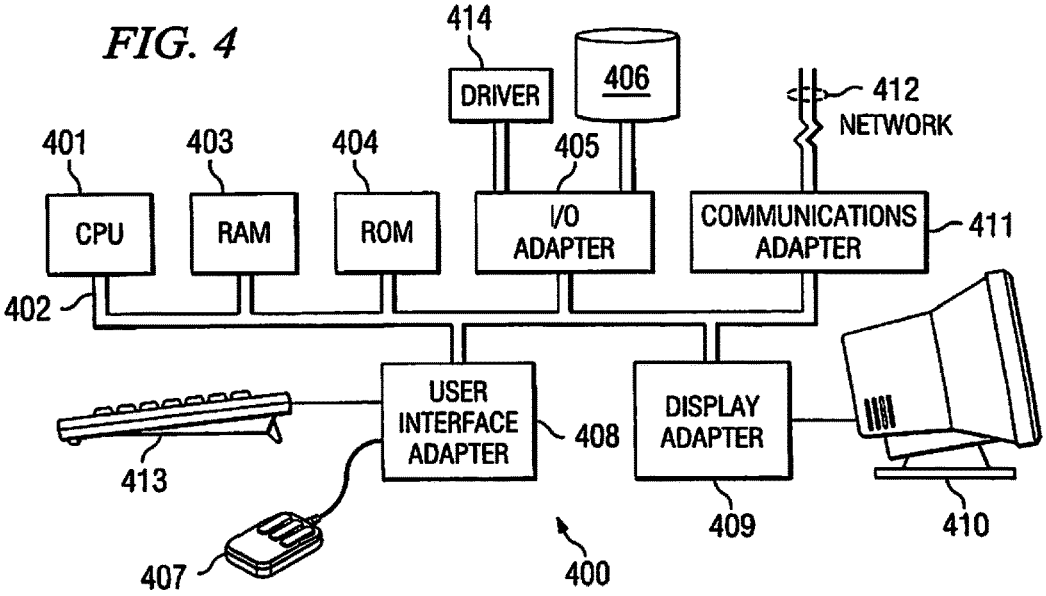
FIG. 4 depicts a block diagram of a computer system which is adapted to use the present invention.

FIG. 4 illustrates computer system 400 adapted to use the present invention. System 400 may be used as either or both of servers 101 and 109. Central processing unit (CPU) 401 is coupled to system bus 402. The CPU 401 may be any general purpose CPU, such as an HP PA-8500 or Intel Pentium processor. However, the present invention is not restricted by the architecture of CPU 401 as long as CPU 401 supports the inventive operations as described herein. Bus 402 is coupled to random access memory (RAM) 403, which may be SRAM, DRAM, or SDRAM. ROM 404 is also coupled to bus 402, which may be PROM, EPROM, or EEPROM. RAM 403 and ROM 404 hold user and system data and programs as is well known in the art.

Bus 402 is also coupled to input/output (I/O) controller card 405, communications adapter card 411, user interface card 408, and display card 409. The I/O adapter card 405 connects to storage devices 406, such as one or more of a hard drive, a CD drive, a floppy disk drive, a tape drive, to the computer system. The I/O adapter card 405 may also connect to a database, such as database 107 and/or database 110. The I/O adapter 405 is also connected to printer 414, which would allow the system to print paper copies of information such as document, photographs, articles, etc. Note that the printer may a printer (e.g. dot matrix, laser, etc.), a fax machine, or a copier machine. The printer 414 may be postage printer 104. Communications card 411 is adapted to couple the computer system 400 to a network 412, which may be one or more of a telephone network, a local (LAN) and/or a wide-area (WAN) network, an Ethernet network, and/or the Internet network. The network 412 may be the network 108. User interface card 408 couples user input devices, such as keyboard 413, and pointing device 407, to the computer system 400. User interface card 408 also provides sound output to a user via speaker(s) 415. The display card 409 is driven by CPU 401 to control the display on display device 410.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for processing a batch of mail items including mail items requiring different postage values using a high speed mail processing system, said method comprising:

tracking, by a server of the high speed mail processing system, each mail item of a plurality of mail items included in said batch of mail items as it flows through the high speed mail processing system;

calculating, by the server of the high speed mail processing system, a postage value for each mail item of said batch of mail items;

generating, by the server, postage indicium data for each mail item of said batch of mail items, wherein postage indicium data for a particular mail item is generated based at least in part on a particular postage value calculated for said particular mail item, wherein different mail items of said batch of mail items have different calculated postage values;

transmitting, by the server, said postage indicium data for each mail item of said batch of mail items to a printer of the high speed mail processing system, said printer communicatively coupled to said server via a network communication link; and printing, by the printer, a shipping label for each mail item of said batch of mail items, wherein each of said shipping labels is printed based on postage indicium data corresponding to one of said mail items of said batch of mail items, wherein each of said shipping labels comprises a full information based postage indicium evidencing a postage value of a mail item, wherein each said full information based postage indicium comprises a computer-readable mark, and wherein said calculating, said generating, said transmitting, and said printing are performed in parallel with respect to different mail items of said batch of mail items.

2. The method of claim 1 wherein said batch of mail items comprises mail items of different classes.

3. The method of claim 1 wherein said calculating comprises:

estimating a weight of a particular mail item based on a weight of one or more component parts of said particular mail item.

4. The method of claim 3 wherein said calculating is based, at least in part, on information associated with a class of said particular mail item, a destination of said particular mail item, or both.

5. The method of claim 1 wherein each of said computer-readable marks comprises encrypted information.

6. A high speed mail processing system configured to process a batch of mail items associated with different postage values, said system comprising:

a printer;

a server comprising a memory and one or more processors communicatively coupled to the memory, wherein said server is configured to perform operations for high speed processing of said batch of mail items, the operations comprising:

tracking each mail item of a plurality of mail items included in said batch of mail items as it flows through the high speed mail processing system;

calculating a postage value for each mail item of said batch of mail items, wherein said batch of mail items includes mail items having different calculated postage values;

generating postage indicium data for each mail item of said batch of mail items, wherein postage indicium data for a particular mail item is generated based at least in part on a particular postage value calculated for said particular mail item; and transmitting said postage indicium data for each mail item of said batch of mail items to said printer of the high speed mail processing system, said printer communicatively coupled to said server via a network communication link, wherein said printer is configured to print a shipping label for each mail item of said batch of mail items, wherein each of said shipping labels is printed based on postage indicium data corresponding to one of said mail items of said batch of mail items, wherein each of said shipping labels comprises a full information based postage indicium evidencing a postage value of a mail item, wherein each said full information based postage indicium comprises a computer-readable mark, and wherein said calculating, said generating, said transmitting, and said printing are performed in parallel with respect to different mail items of said batch of mail items.

7. The high speed mail processing system of claim 6 wherein said batch of mail items comprises mail items of different classes.

8. The high speed mail processing system of claim 6 wherein said server is further configured to:

estimate a weight of a particular mail item based on a weight of one or more component parts of said particular mail item.

9. The high speed mail processing system of claim 8 wherein said calculation is based, at least in part, on information associated with a class of said particular mail item, a destination of said particular mail item, or both.

10. The high speed mail processing system of claim 6 wherein each of said computer-readable marks comprises encrypted information.

11. The method of claim 1, further comprising sending, by said server of said high speed mail processing system, said postage indicium data to a remote database for storage.

12. The high speed mail processing system of claim 6, wherein said server is further configured to send said postage indicium data to a remote database for storage.

* * * * *